US005704169A

United States Patent [19]

Richter

[11] Patent Number: 5,704,169

[45] Date of Patent: Jan. 6, 1998

[54] SPACE TRUSS DOME

[75] Inventor: Donald L. Richter, Las Vegas, Nev.

[73] Assignee: Temcor, Carson, Calif.

[21] Appl. No.: 150,101

[22] PCT Filed: Sep. 9, 1983

[86] PCT No.: PCT/US93/08443

§ 371 Date: Sep. 1, 1995

§ 102(e) Date: Sep. 1, 1995

[87] PCT Pub. No.: WO95/07392

PCT Pub. Date: Mar. 16, 1995

[51] Int. Cl.[6] ..... E04B 1/32; E04C 3/00

[52] U.S. Cl. ..... 52/81.2; 52/81.1; 52/639; 52/652.1; 52/745.07

[58] Field of Search ..... 52/80.1, 81.1–81.3, 52/638, 639, 648.1, 652.1, 653.2, 745.07

[56] References Cited

U.S. PATENT DOCUMENTS

| | | |
|---|---|---|
| 3,026,651 | 3/1962 | Richter . |
| 3,042,050 | 7/1962 | Finlayson . |
| 3,058,550 | 10/1962 | Richter . |
| 3,063,519 | 11/1962 | Richter . |
| 3,194,360 | 7/1965 | Richter . |
| 3,330,201 | 7/1967 | Mouton . |
| 3,354,591 | 11/1967 | Fuller . |
| 3,909,994 | 10/1975 | Richter . |
| 3,974,600 | 8/1976 | Pearce . |
| 4,611,442 | 9/1986 | Richter . |
| 4,711,057 | 12/1987 | Lew et al. . |
| 4,711,063 | 12/1987 | Richter . |
| 4,750,807 | 6/1988 | Felix . |
| 4,803,824 | 2/1989 | Coppa . |
| 4,807,408 | 2/1989 | Lew et al. . |

FOREIGN PATENT DOCUMENTS

| | | |
|---|---|---|
| 742407 | 9/1966 | Canada . |
| 1101626 | 2/1989 | Canada . |

*Primary Examiner*—Robert Canfield
*Attorney, Agent, or Firm*—Christie, Parker & Hale, LLP

[57] ABSTRACT

The basic shape of a large span dome (10) is defined by a primary network (20) of structural struts (15) which are so arranged between their junctions (16) that they fully triangulate the surface (13) of the dome. The struts throughout the network have substantially uniform cross-sectional dimensions which are defined with reference to strut loads encountered at and near the perimeter (37) of the dome. The central portion of the network is strengthened to withstand snap-through of the dome by a truss system (30) comprised of a secondary network (35) of truss members (33) which lie in a secondary surface (31) which is inside the dome and is spaced from the dome's triangulated surface. The primary (20) and secondary (35) networks are tied together by tie members (36) which extend between connections (34) of the truss members and the strut junctions (16) and which lie in the planes of webs (25) of respective struts. The assembly of the tie members to the strut junctions can be achieved by use of the same fasteners (26) which connect the struts to their junctions.

10 Claims, 7 Drawing Sheets

15
16
17
20
23
24
25
26
27
28
33
34
35
36
44
46
47
4

14
16
16
20
15
15
19
16
15
37

14

35
34
33
38
50
50
38
38
34
33
51
51
42

14
16
15
33
16
34
334
341
34
33
15
16
15
16
37

SPACE TRUSS DOME

FIELD OF INVENTION

This invention pertains to space trusses. More particularly, it pertains to structural truss arrangements composed of a plurality of stable modules which are efficiently interconnectible to define a truss system useful in diverse applications.

BACKGROUND OF THE INVENTION

While the present space truss has utility in structures of many kinds, it is described herein principally in the context of large span domes for which it first was conceived and developed. Following a description of the invention in that context, its application to other kinds of structures is discussed.

The owner of this invention (namely, Temcor of Carson, Calif., U.S.A.) has developed three kinds of light, strong, structurally efficient domes. In order of ascending range of spans practicable, they are the Geodesic Dome to which U.S. Pat. Nos. 3,026,651, 3,058,550, 3,063,519 and 3,194,360 are pertinent, the Polyframe Dome to which U.S. Pat. No. 3,909,994 is pertinent, and the Richter Dome to which U.S. Pat. Nos. 4,611,442 and 4,711,063, Canadian Patent 1,268,917 and U.K. Patent 2,194,735 are pertinent. The present space truss has utility in domes which use the design principles of Polyframe Domes.

As set forth in U.S. Pat. No. 3,909,994, the principal surface of a spherically curved dome, or that of a dome having other desired curvature, is triangulated over its surface to define triangular zones of substantially equal area, such zones being predominantly of preferably equilateral configuration. The dome surface is fully tiled by such triangular zones. The edges between adjacent zones in the actual dome are defined by structural strut members which preferably have cross-sections resembling those of I-beams. At the contiguous corners of the triangular zones, plural struts are interconnected at hub-like nodes; usually there are five or six struts connected at a node within the perimeter of the dome. The openings between the interconnected struts are closed by sheet metal closure panels which preferably are tensioned between the struts to which they are connected. The struts, node hubs and closure panels preferably are defined by similar metals which typically is aluminum.

Regardless of the structural system used to define them, domes are subject to varying extents to the troublesome phenomenon called "snap through." Snap through occurs when the loads on a dome become so great that the dome reverses curvature and becomes concave upwardly, rather than convex upwardly, over at least a portion of its area. Such loads can occur when natural loads, such a wind, snow or ice loads on the dome, when added to loads due to lights, scoreboards, sound equipment, climate control equipment, catwalks and the like suspended from the interior of the dome, reach critical levels. Snap through is a more serious problem in large diameter shallow (relatively low height) domes than it is in smaller diameter domes which are high relative to diameter. Shallow domes generally are preferred over higher domes. Domes become more resistant to snap through proceeding form the top of the dome to its perimeter where the dome structural elements are more vertical than they are at and adjacent to the top of the dome.

An obvious approach to preventing the occurrence of snap through in a dome is to make the structural members of the dome sufficiently strong to adequately resist and prevent snap through. That approach requires the use in the dome structure of struts of greater section modulus (i.e., depth) either throughout the dome or in the areas most susceptible to snap through. If stronger struts are used throughout the dome, substantial portions of the dome will be overdesigned and the dome will be heavier and more costly than truly required to effectively deal with the problem of snap through. The use of stronger, i.e., deeper, struts can be confined to the portions of the dome which are most susceptible to snap through; that approach, however, has been found to require complicated and expensive hub structures at those places in the dome where struts of different depth are to be interconnected. It is seen, therefore, that conventional approaches to the prevention of snap through in domes have different deficiencies and disadvantages.

Thus, it is apparent that a need exists for structural arrangements and procedures which overcome the deficiencies and disadvantages of known approaches to preventing snap through in domes having structural flaming systems of the kinds now being used.

SUMMARY OF THE INVENTION

This invention meaningfully addresses the need which has been identified. It does so by providing a space truss system which has particular utility in structures in which the principal surfaces of interest are curved. The truss system, although believed to have broad application because of its efficiency, has particular advantages when used in dome flaming systems of the kind where dome struts are defined by structural members having cross-sectional configurations similar to those of I-beams.

Generally speaking, in a structural form of the invention, a principal surface of the trussed structure has a desired curvature which is defined by principal structural members. A principal structural grid is formed by the principal structural members which are interconnected at junctions and which subdivide the principal surface into a plurality of nested primary triangular areas. The truss is present adjacent a central portion of the principal surface, and that portion is spaced inwardly from the perimeter of the principal surface. The truss also includes a secondary structural grid which is comprised of secondary structural members. The secondary members are disposed in a secondary surface which is spaced from the principal surface and which can have essentially the same center of curvature as the principal surface. The secondary members form between connections thereof in the secondary surface a plurality of interconnected and un-nested secondary triangular areas which correspond in number to the number of primary triangular areas. Each secondary area has a corner associated substantially with the midlength of a corresponding edge of its corresponding primary area. The truss also includes a plurality of structural elements which interconnect the principal and secondary grids. Those elements are related in pairs and join each connection in the secondary grid to the junctions at the ends of the principal structural member with which the connection is most closely spatially associated.

A procedural embodiment of the invention provides an efficient method for defining a large span dome which has a principal surface of desired curvature formed by a primary network comprised by a plurality of structural struts interconnected at junctions spaced throughout that surface. The method includes the step of defining the principal network using struts having cross-sectional dimensions and shapes which are substantially uniform throughout the network. The method also includes the step of defining those cross-sectional dimensions and shapes with reference to loads and loading modes expected to be encountered by network struts at and adjacent to a perimeter of the dome. The method includes the further step of supplementing the network over a selected central area of the dome with a truss system, inside the dome and connected to the network, which has structural strength in combination with that of the adjacent portions of the network to effectively withstand expected loads tending to produce snap through of the network.

DESCRIPTION OF DRAWINGS

The above-mentioned and other features of this invention are more fully set forth in the following description of a preferred and other embodiments of the invention, which description is presented with reference to the accompanying drawings, wherein:

FIG. 5 includes legends which show how the several triangular faces of the octahedral module are lined in FIG. 5 for identification of the several faces;

DESCRIPTION OF THE ILLUSTRATED EMBODIMENTS

Figure 1:
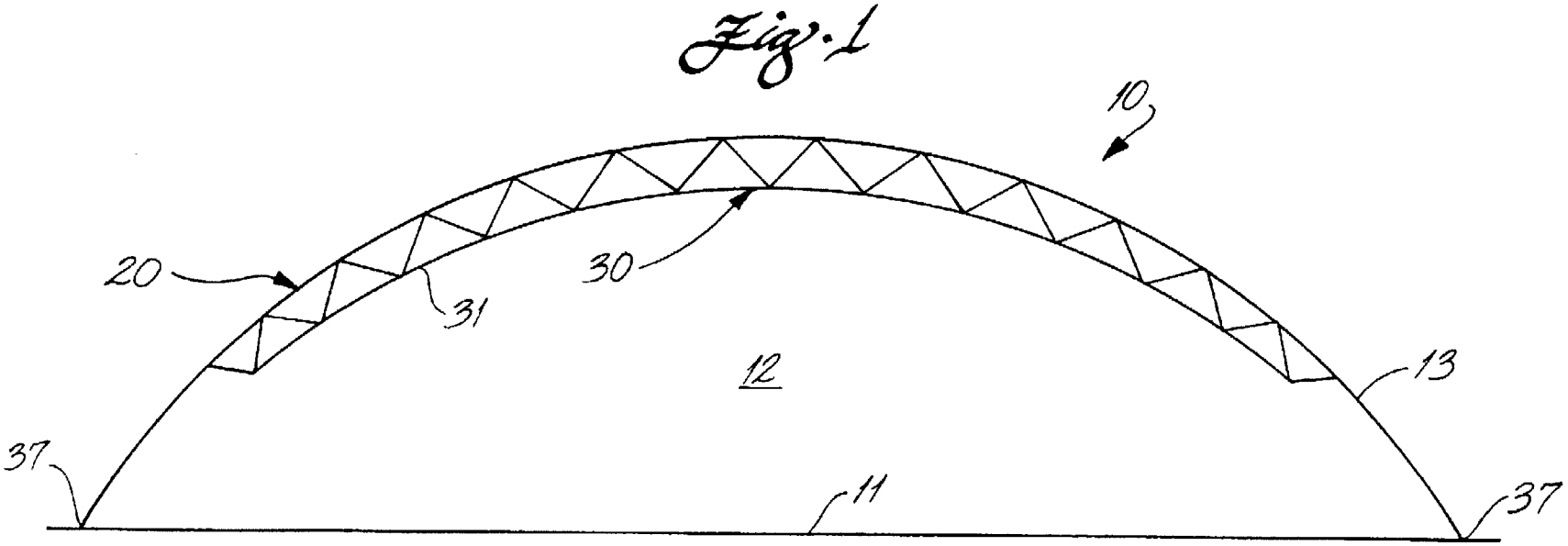
FIG. 1 is a simplified cross sectional elevation view of a dome which is internally braced over a selected portion thereof by a space truss arrangement according to this invention.
Figure 7:
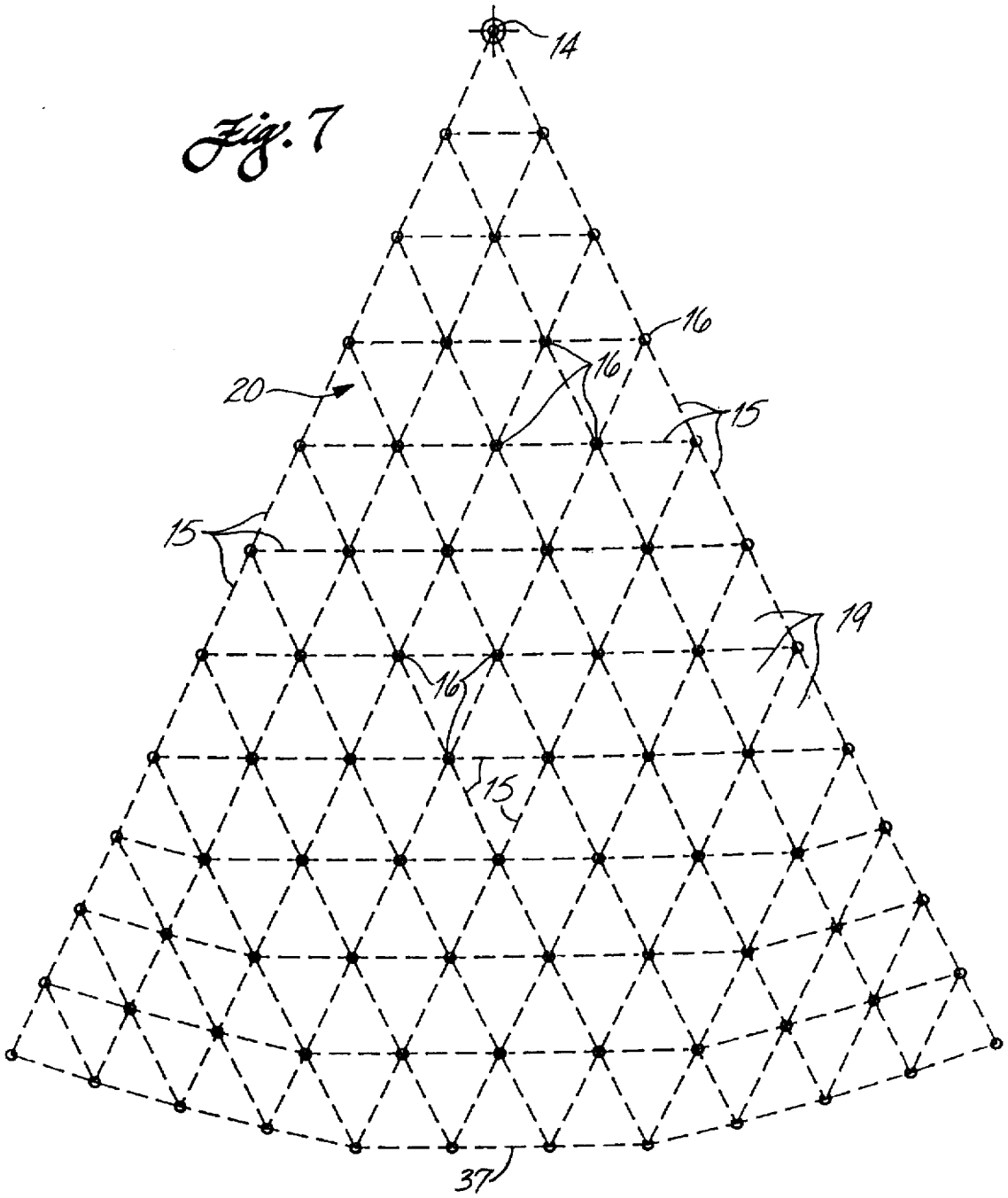
FIG. 7 is a diagram of one of several repeating segments of the dome of FIG. 1 and shows the arrangement of structural members and their junctions in a principal structural grid for the dome.

FIG. 1 is a simplified cross-sectional elevation view of a large span dome 10 which, with supporting surface 11, encloses a space 12 within the dome. The dome has a principal surface 13 of selected curvature which, for purposes of example in the present descriptions, is assumed to be of spherical curvature. FIG. 7 is a top plan view of one of several repeating segments of dome 10. In FIG. 7, location 14 represents the apex of the dome on its vertical axis of symmetry.

Figure 2:
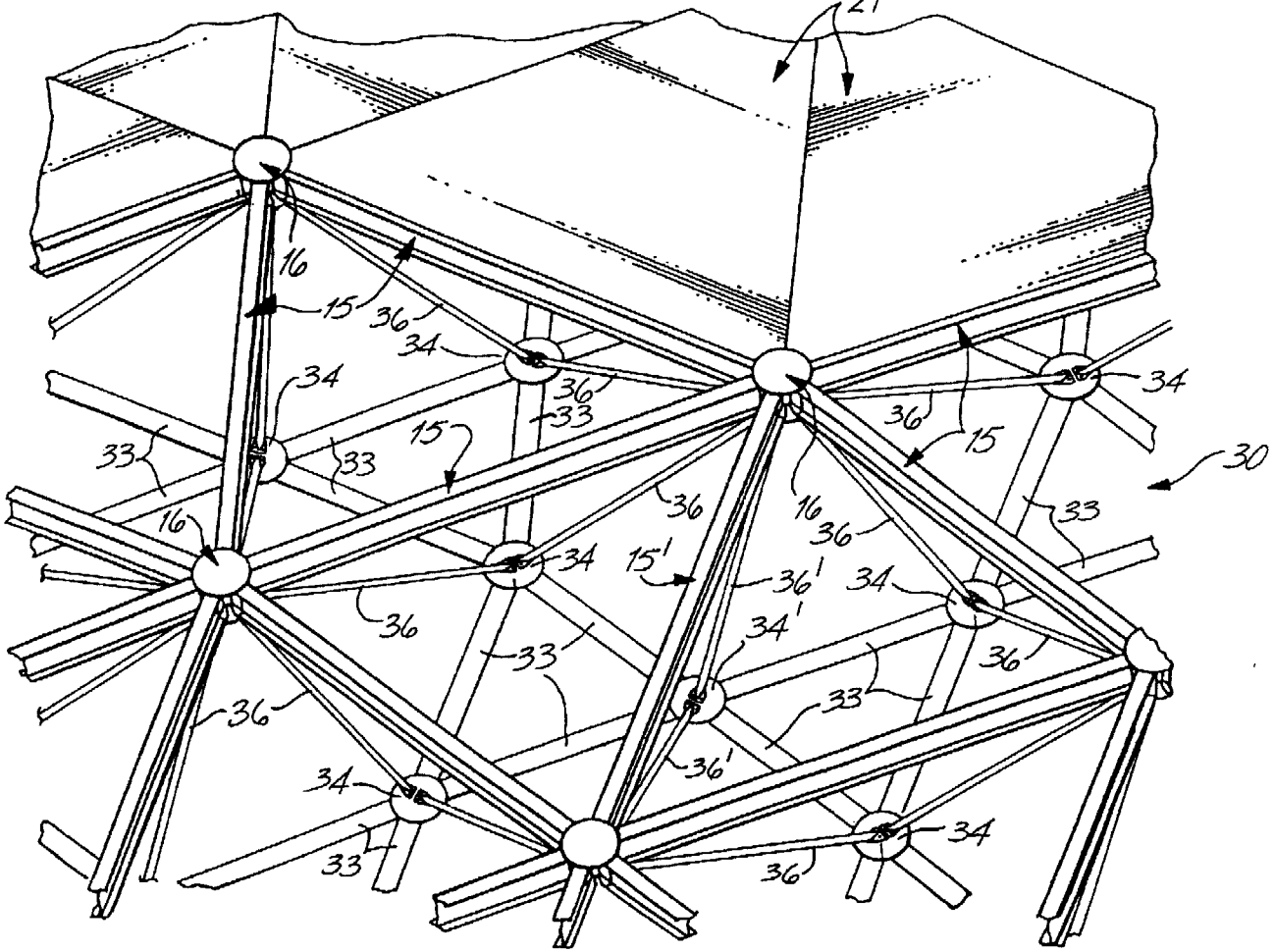
FIG. 2 is a simplified fragmentary perspective view of a portion of the trussed dome shown in FIG. 1.
Figures 3, 4:
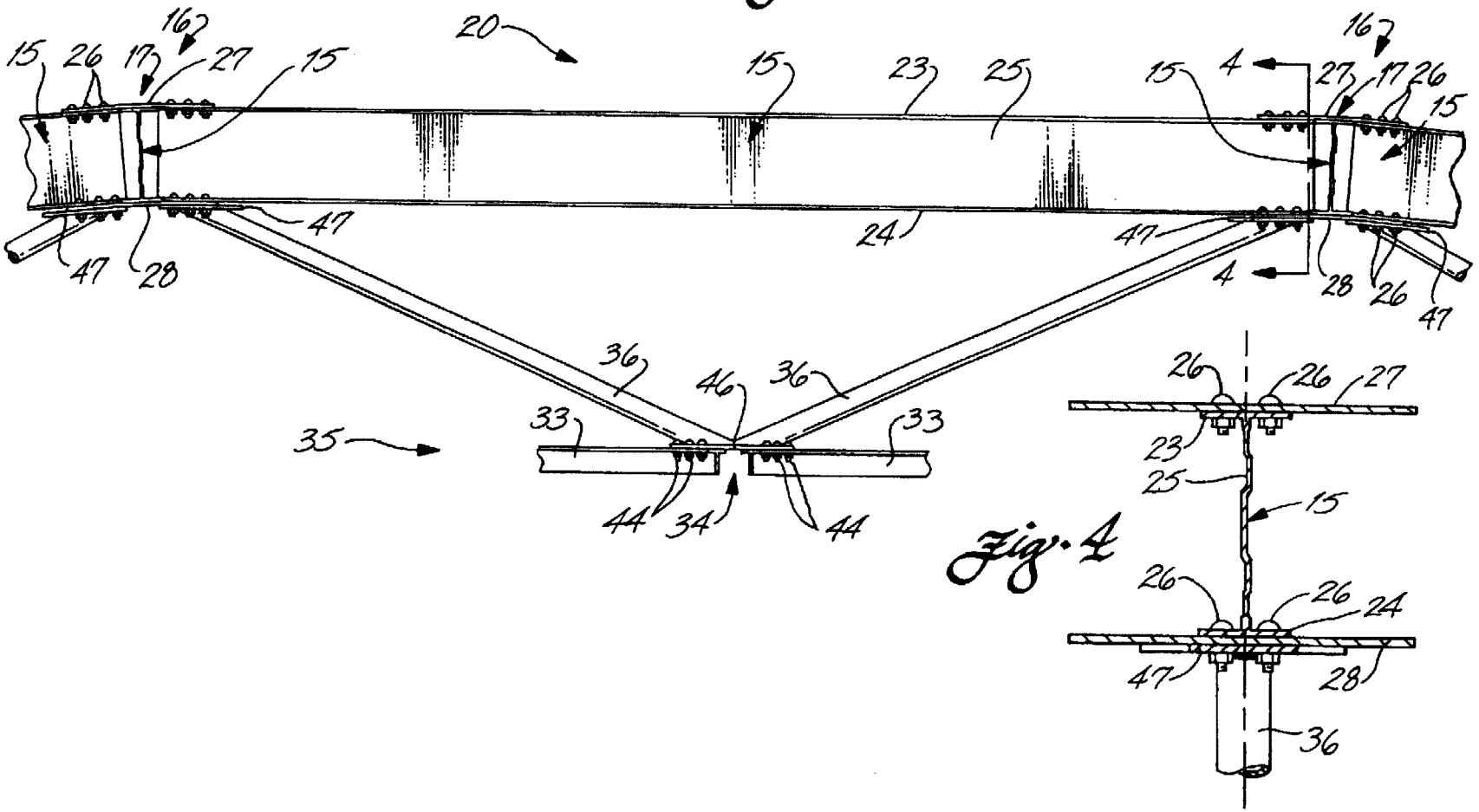
FIG. 3 is a fragmentary cross-sectional elevation view of the dome and truss arrangement shown in FIG. 2.
FIG. 4 is an enlarged cross-sectional elevation view taken along line 4—4 in FIG. 3.

The basic curvature of dome 10 preferably is defined by an assembly of principal structural members and closure panels according to the descriptions of U.S. Pat. No. 3,909,994. Accordingly, as shown in FIGS. 2, 3 and 7, the basic form of dome 10 is defined by principal structural strut members 15 which are interconnected at junctions 16 defined by hub assemblies 17 which are shown best in FIGS. 2 and 3. Struts 15 and junctions 16 are arranged so that dome surface 13 is triangulated by the struts; that is, the dome surface is divided into a plurality of nested triangular areas 19 which, as shown in the plan view of FIG. 7, preferably are of equilateral configuration. Thus, the principal structural members which form the basic shape of dome 10 are interconnected to define a primary structural grid 20 which has triangular openings 19 in it. Those triangular openings are closed by closure panels 21, some of which are represented in FIG. 2. As shown in FIG. 4, it is preferred that the several principal structural strut members 15 of the dome have cross-sectional configurations which resemble those of I-beams and so have parallel top and bottom flanges 23 and 24 which are spaced apart by and interconnected by webs 25 which lie substantially in planes perpendicular to the planes of the related parallel top and bottom flanges. The individual struts in principal grid 20 of the dome are interconnected at hub assemblies 17 by being fastened, as by bolts 26, to suitably dished circular upper and lower gusset plates 27 and 28, respectively. See FIG. 4, for example. All of struts 15 are of the same depth and have substantially the same cross-sectional configurations and dimensions.

As shown in FIG. 1, the primary structural grid 20 of dome 10, which defines the dome's principal surface 13, is supplemented and strengthened by an internal truss system 30 in the upper central part of the dome. In FIG. 1, the depth of the truss inwardly from principal grid 20 is exaggerated for purposes of illustration. The truss defines an inner secondary dome surface 31 which is spaced from the dome's principal surface 13. As shown in FIG. 1, the nature of the spacing of surface 31 from surface 13 is a uniform or parallel spacing in which both surfaces have the same center of curvature, but surface 13 has a larger radius of curvature than does surface 31.

Figure 8:
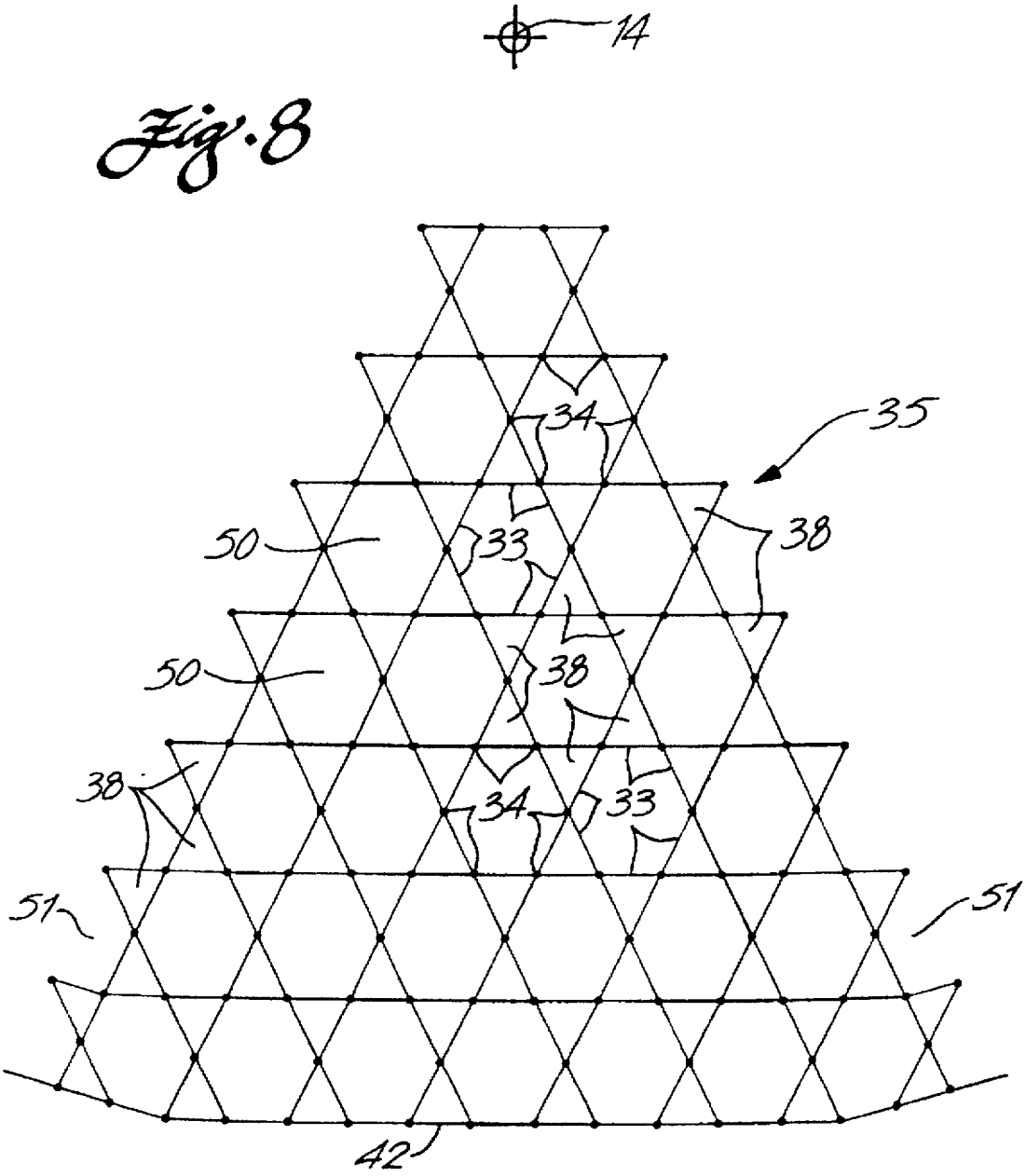
FIG. 8 is a diagram, similar to that of FIG. 7, which pertains to the same segment of the dome represented in FIG. 7 and which depicts the arrangement of structural members and their connections in a secondary structural grid of the truss arrangement shown in FIG. 2.
Figure 9:
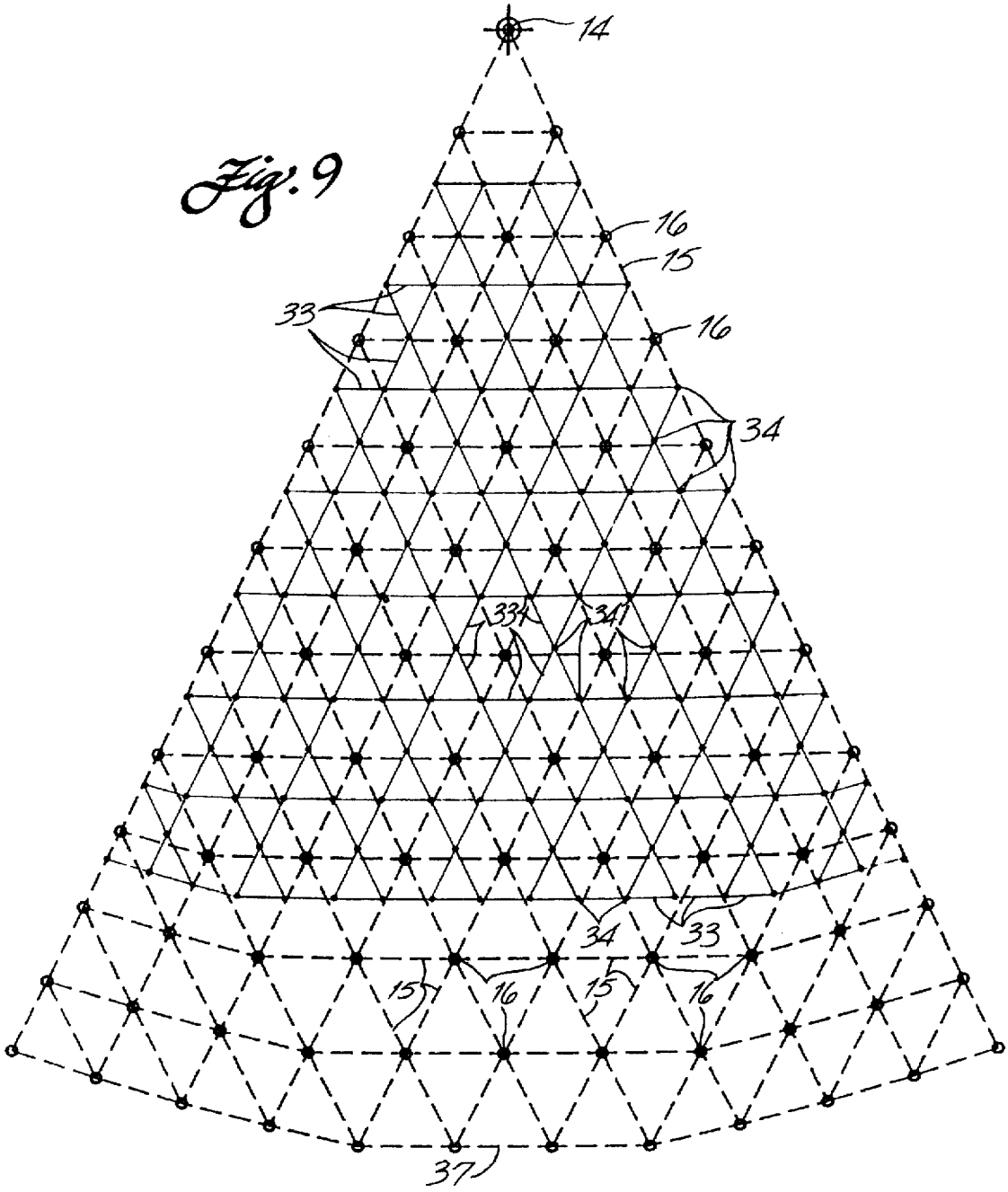
FIG. 9 is a diagram which combines the representations of FIGS. 7 and 8 as a schematic fragmentary top plan view of the same segment of the dome.

FIGS. 2 and 8 show that truss 30 is composed of two kinds of structural elements, namely, truss members 33 which lie in secondary surface 31 and which are suitably connected at connections 34 to form a secondary structural grid 35 in the dome, and tie members 36 which structurally join secondary grid 35 to principal grid 20 and which extend between connections 34 and related junctions 16 as described below. FIG. 7 shows only the struts 15 and their junctions in the structural network of grid 20. FIG. 8 pertains to the same segment of dome 10 as does FIG. 7 and shows only the truss members 33 and their connections 34 in correct spatial relation to dome axis 14. FIG. 9 is a combination of FIGS. 7 and 8 and is, in effect, a superposition of FIG. 7 upon FIG. 8 with registry of locations 14. Because both of FIGS. 7 and 8 are plan views, their combination increasingly reveals the effects of the spacing between spherical surfaces 13 and 31 as one moves from the dome axis 14 toward the perimeter 37 of the dome.

FIG. 7 shows that principal dome struts 15, which lie in the dome's principal surface 13, fully triangulate that surface because they are arranged to cause that surface, in effect, to be subdivided into a plurality of fully nested triangular areas 19. Areas 19 fully the, i.e., cover, surface 13. By contrast however, as shown in FIG. 8, truss members 33, which lie in the dome's secondary surface 31, only partially triangulate that surface; they form in surface 31 a plurality of triangular areas 38 which are interconnected corner to corner, not side to side, and so form an array of connected but un-nested triangular areas 38. Areas 38 surround and define hexagonal areas 50 and pentagonal areas 51 in the secondary grid 35 inwardly of its perimeter 42.

There are in secondary grid 35 the same number of triangular areas 38 as there are triangular areas 19 in that portion of primary grid 20 as is subtended by grid 35. When the two grids are viewed together in plan view, as in FIG. 9, it is seen that each secondary grid triangular area 38 corresponds to a respective primary grid area 19 and has a special relation to it. When a triangle 38 is projected normally onto the plane of is corresponding primary triangle 19, the corner of each area 38 lies at the midlength, or substantially so, of a respective edge of the corresponding primary area 19. That is, when each primary area 19 is viewed from directly above it, the sides of the secondary triangular area below it appear to connect the midpoints of the sides of the primary triangle 19. Thus, it follows that each secondary triangular area has an areal extent which is substantially one-fourth that of the area of the primary triangle to which is corresponds. As shown in FIG. 2, the truss tie members extend in pairs, in diverging relation, from each truss member connection 34 in secondary grid 35 to the junctions at the opposite ends of the principal strut 15 which has its midpoint lying close to that connection 34. By way of example in FIG. 2, connection $34^1$ in the secondary grid of truss members 33 lies radially inwardly of the dome from the midlength of principal strut $15^1$, and so the tie members $36^1$ which diverge from connection $34^1$ are arranged to extend to the respective junctions 16 at the opposite ends of strut $15^1$. Tie members 36 are not visible in FIG. 9 because they are hidden by strut member 15.

Figure 5:
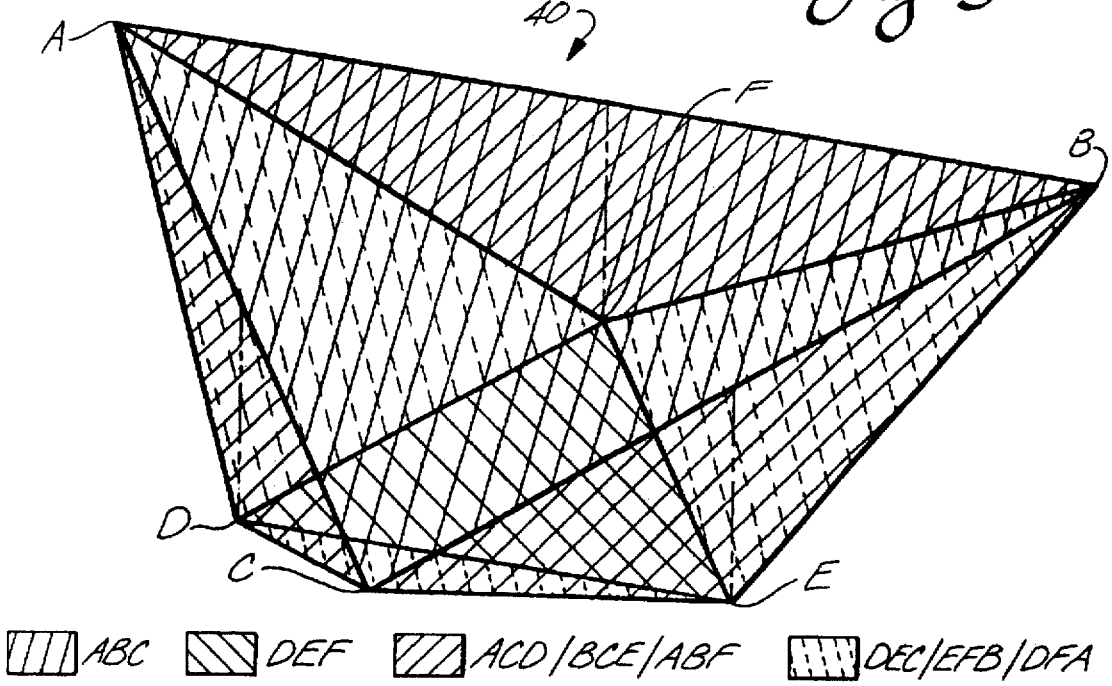
FIG. 5 is a representation of an octahedral module of the space truss shown in FIG. 2.

Viewed in another way which is illustrated in FIG. 5, truss system 30 can be visualized as composed of interconnected geometric modules 40, each of which has the geometry of an octahedron which has two spaced triangular faces and six further triangular faces disposed between and connected to them. Thus, as module 40 is depicted in FIG. 5, it has a triangular principal face having corners A, B and C, and a secondary triangular face with corners D, E and F. Faces ABC and DEF are spaced from each other; they correspond, respectively, to a primary triangular area 19 in dome principal structural grid 20 and to a secondary triangular area 38 in the dome's secondary grid 35. Points D, E and F lie oil lines which are perpendicular bisectors of respective edges AC, BC and AB of primary face ABC; when the outline of face DEF is projected normally onto the plane ABC, points D, E and F appear to lie substantially at the midpoints of primary face edges AC, BC, and AB, respectively. The area of face DEF is substantially one-fourth that of face ABC.

Further, module 40 has three tertiary faces ACD, BCE, and ABF, each of which includes a respective edge of the primary face and a respective corner of the secondary face. The module has three additional faces ADF, BEF, and CDE, each of which includes a respective edge of the secondary face and a respective corner of the primary face. When the module is embodied structurally in truss system 30, each module primary face edge is defined by a respective strut 15 and each primary face corner corresponds to a junction 16, each module secondary face edge is defined by a truss member 33 and each secondary face corner corresponding to a miss connection 34, and the remaining six edges of the module are defined by tie members 36. In the truss system, adjacent modules abut at adjacent tertiary faces. Thus, in the structural embodiment of a pair of adjacent abutted modules, hie two adjacent modules share a strut 15 and its end junctions 16, a truss member connection 34, and the two tie members 36 which join that connection 34 to those junctions 16.

Where, as in the depicted case of dome 10, the module primary and secondary face geometries are substantially those of equilateral triangles, six (usually) or five (sometimes) modules (struts) connect at each junction 16 inwardly of the perimeter 37 of the dome, and four truss members 33 are structurally joined at each connection 34 in the dome's secondary grid 35 inwardly of the perimeter 42 (FIG. 8) of the truss system.

Figure 6:
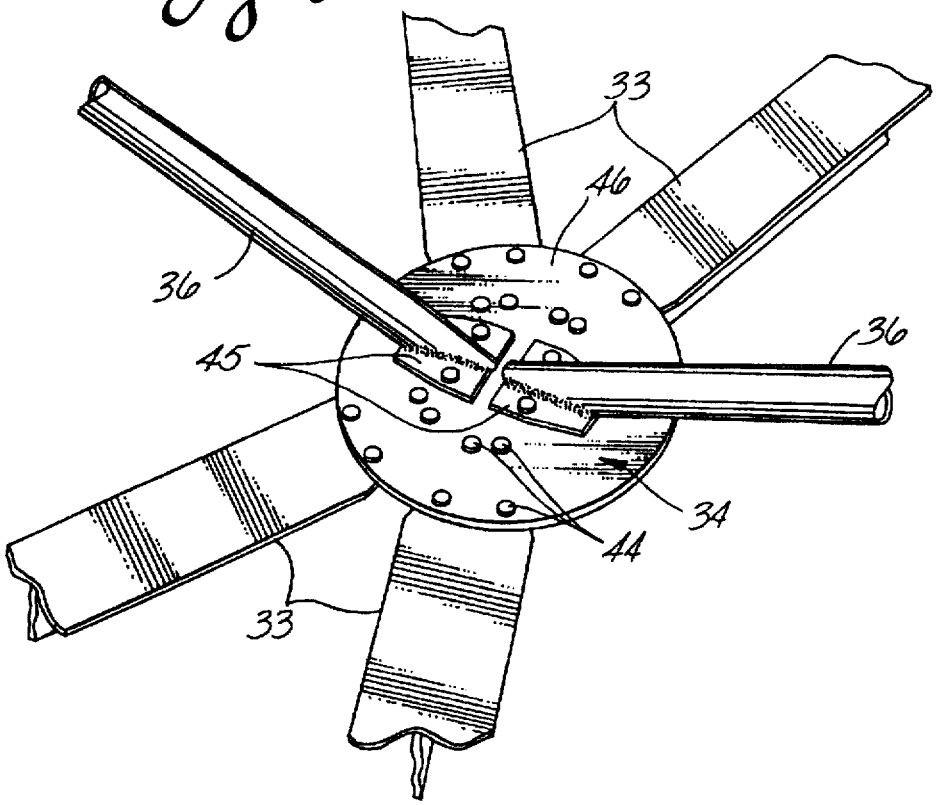
FIG. 6 is a fragmentary perspective view of a connection site of secondary truss structural members and other truss elements in the space truss shown in FIG. 2.

The principles and geometric relations described above result in a tress system 30 for the primary structural grid of dome 10 which is easily and economically manufactured and assembled. The principal structural grid 20 is comprised of strut member 15 of uniform cross-sectional shape and dimension which, as noted above, preferably are in the nature of I-beams. The secondary grid 35 can be comprised by structural members of suitable and uniform cross-sectional shape and dimension, such as, preferably, tees or angles. The truss tie members 36 can be defined principally by structural elements of uniform cross-sectional shape and dimension, such as, preferably, tubes. The connections 34 between related tie members and truss members can be achieved efficiently by the use of bolts 44 to connect the ends of truss members 33 and bolting pads 45 on the ends of the tie members 36 to preferably circular and substantially planar bolting plates 46 (FIG. 6) which use easily defined bolt hole patterns. Alternatively, a diverging pair of members 36 can be welded at a manufacturing facility to their associated bolting plate 46 (see FIG. 3) as a prefabricated subassembly to which the relevant truss members 33 can be bolted at the site of assembly and erection of the dome; such subassemblies are readily transportable from a place of dome component manufacture to a site of dome assembly.

Further, the ends of the tie members 36 which are assembled to strut junction hub assemblies 17 can be clamped via affixed bolting pads 47 to the bottom gusset plate 28 on the side of the plate opposite the lower flange 24 of a dome strut 15 by use of the same bolts 26 which connect the strut flanges to the gusset plate. See FIG. 4. Thus, the same gusset plate bolt hole pattern as formerly was used in a dome according to U.S. Pat. No. 3,909,994 can be used in defining a trussed dome according to this invention. Manufacturing and assembly efficiencies are apparent.

It is a characteristic of truss system 30 that all angles associated with the relations of truss members to each other and of the tie members to truss members and to dome struts are defined in two dimensions, not in three dimensions. Thus, only plane angles, and not solid angles, need be dealt with in the design of the tress system as an adjunct and supplement to the principal structural network of the dome. The tie members lie in the planes of the of the webs of the dome strut members with which they are most closely associated. Loads are transferred efficiently between the components of the principal structural network of struts 15 and hub assemblies 17 and the components of the truss system, namely, the tie members and the truss members and their connections. Loads tending to wrack or twist the strut members about their neutral axes are minimized. As a result, the domes principal structural network 20 can be defined of struts having dimensions and weights determined with reference to the loads and modes of loading pertinent to the struts in the untrussed outer portions of the dome. Heretofore, it was the loads and modes of loading pertinent to the strut members in the central portion of the dome which determined the dimensions and weights of structural members throughout the dome. In those latter cases, the use of strut members of the same cross-section throughout the dome resulted in the dome being over-designed (i.e., overly heavy and costly) in its outer portions adjacent its perimeter.

It is apparent, therefore, that the space truss aspects of the invention enable the economic design, manufacture and assembly of known kinds of domes, the design processes for which can deal with the topic of snap-through separately from other topics relevant to the design process. The topic of snap-through can be dealt with essentially entirely in the design of the internal truss supplement to the dome's principal structural network which provides the principal structure 13 of the dome.

While the preceding description has been of a dome having a secondary surface 31 spaced a constant distance radially from the dome's principal surface 13 (the surfaces are concentric about a common center of curvature), that relation is not a requirement of the practice of this invention. If desired, the spacing of the secondary surface from the principal surface can vary from place to place on the latter surface. The truss system can be deeper relative to the dome principal structural grid at the top of the dome than at the perimeter 42 of the truss system, as by having a flat secondary surface or one which has a radius of curvature relatively larger than that radius represented in FIG. 1.

Also the present space truss system can be used in domes which have principal surfaces curved other than spherically, such as in domes having ellipsoidally or cylindrically curved principal surfaces. Moreover, the space truss system of the invention can be used in structures other than domes, such as structures like bridges which have flat or simply arched principal surfaces.

Persons skilled in the art, science and technology to which this invention pertains will recognize that the preceding description of presently preferred and other structural and procedural embodiments of this invention has been set forth by way of example and for purposes of explanation and illustration, and not as an exhaustive catalog of all of the structural and procedural ways and forms in which this invention can be practiced. Such persons will understand that modifications of the described arrangements and procedures can be defined and pursued Without departing from, and while using, the principles and advances of this invention. Therefore, the following claims and definitions of this invention are to be given the broadest scope and interpretation which they fairly support consistent with the state of the relevant art existing when this invention was made.

What is claimed:

1. A dome having a principal surface of desired three-dimensional curvature within a perimeter thereof and comprising:

a) a principal structural grid formed by a plurality of principal structural members which are interconnected at junctions thereof to define the principal surface and to subdivide the principal surface into a plurality of nested primary triangular areas and which are of substantially uniform depth normal to the principal surface throughout the principal grid, b) a secondary structural grid comprised by secondary structural members disposed in a secondary surface which is substantially smaller in area than the principal surface, which is and spaced from and subtends at least a portion of the principal surface, which is spaced inwardly from the perimeter of the principal surface, the secondary members forming between connections thereof in the secondary surface a plurality of interconnected and un-nested secondary triangular areas corresponding in number to the number of primary triangular areas in said portion of the principal surface, each secondary area having a corner associated substantially with the midlength of a corresponding edge of its corresponding primary area, and c) a plurality of structural elements interconnecting the principal and secondary grids, the elements being related in pairs and joining each secondary grid connection to the primary grid junctions at the ends of the principal member with which the secondary grid connection is most closely associated in space.

2. Apparatus according to claim 1 wherein the principal structural members have webs in the plane of each of which within said portion of the principal surface there substantially lies a corresponding corner of the corresponding secondary triangular area, and the structural elements connected to each principal member lie substantially in the plane of the web of that member.

3. Apparatus according to claim 2 wherein each web has an edge toward the secondary surface which terminates in a flange disposed substantially normal to the web, each junction between connected principal members includes a plate to which the flanges of those members are bolted, and the connection of the structural elements to the junctions include bolts comprising the connections of the principal members to the plates.

4. Apparatus according to claim 2 in which the structural elements are tubular.

5. Apparatus according to claim 1 wherein the secondary surface is uniformly spaced from the dome principal surface.

6. Apparatus according to claim 1 wherein the structural elements interconnected between the principal and secondary grids have bolted connections to the principal structural members.

7. Apparatus according to claim 1 wherein, within said portion of the dome principal surface, the principal structural members defining a triangular primary area, the secondary structural members defining the secondly triangular area which corresponds to that primary area, and the pairs of structural elements which are associated with that primary area and that secondary area comprise a truss module, the dome within said portion of its principal surface being composed of a plurality of abutting adjacent truss modules, and in Which each two abutting modules share and have in common one principal structural member and the two junctions at the ends thereof, a connection in the secondary grid, and the pair of structural elements which interconnect that secondary grid connection and those two principal grid junctions.

8. A method for defining a large span dome having a principal surface of desired curvature defined by a primary network comprised by a plurality of structural struts interconnected at junctions spaced throughout the surface, the method comprising the steps of:

a) defining the principal network with struts having cross-sectional dimensions and shapes which are substantially uniform throughout the network, b) defining those cross-sectional dimensions and shapes with reference to loads and loading modes expected to be encountered by network struts at and adjacent to a perimeter of the dome, and c) supplementing the network over a selected central area of the dome with a truss system which is connected inside the dome to the network and which has structural strength in combination with that of the adjacent portions of the network to effectively withstand expected loads tending to produce snap-through of the network.

9. The method of claim 8 in which the primary network subdivides the principal surface into a plurality of triangular primary areas having at each corner thereof a junction of plural struts, and including the further step of defining the tress system as a secondary structural grid comprised by secondary structural members disposed in a secondary surface spaced from the principal surface, the secondary members forming between connections thereof in the secondary surface a plurality of secondary triangular areas corresponding in number to the number of primary triangular areas in the selected central area of the dome, each secondary area having a corner associated substantially with the midlength of a corresponding edge of its corresponding primary area, and a plurality of structural elements interconnecting the principal network and the secondary grid, the elements being related in pairs and joining each secondary grid connection to the junctions at the ends of the principal network strut with which the connection is most closely associated in space.

10. A method for internally bracing against substantial curvature change a dome having a principal surface of selected curvature which is triangulated within a dome perimeter by structural members interconnected at junctions essentially in the surface, the method comprising the steps of:

a) defining inside the dome adjacent a selected portion of the principal surface spaced inwardly from the dome perimeter a grid of structural elements arranged to define a plurality of corner-connected un-nested triangular areas each of which has a corner thereof located adjacent substantially the midlength of a principal surface structural member so that each area lies subjacent a corresponding triangle of structural members, and b) structurally joining each corner connection in the grid of structural elements to each of the structural member junctions most proximate thereto.

* * * * *

UNITED STATES PATENT AND TRADEMARK OFFICE

CERTIFICATE OF CORRECTION

PATENT NO. : 5,704,169
DATED : January 6, 1998
INVENTOR(S) : Donald L. Richter

It is certified that error appears in the above-indentified patent and that said Letters Patent is hereby corrected as shown below:

Column 4, line 57, replace "fully the," with -- fully tile, --.
Column 5, line 38, replace "lie oil" with -- lie on --
Column 5, lines 55,56, replace "corresponding to a miss" with -- corresponds to a truss --.
Column 5, line 60, change "hie" to -- the --.
Column 6, line 6, change "tress" to -- truss --.
Column 6, line 44, change "tress" to -- truss --.
Column 8, line 31, replace "secondly" with -- secondary --.
Column 8, line 37, change "Which" to -- which --.
Column 8, line 65, change "tress" to -- truss --.

Signed and Sealed this

Twenty-fourth Day of March, 1998

Bruce Lehman

*Attest:*

BRUCE LEHMAN

*Attesting Officer*

*Commissioner of Patents and Trademarks*